US008993118B2

(12) United States Patent
Hirano et al.

(10) Patent No.: US 8,993,118 B2
(45) Date of Patent: Mar. 31, 2015

(54) STEEL SHEET FOR CONTAINER EXCELLENT IN CORROSION RESISTANCE

(75) Inventors: Shigeru Hirano, Tokyo (JP); Makoto Kawabata, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/636,727

(22) PCT Filed: Mar. 24, 2011

(86) PCT No.: PCT/JP2011/058156

§ 371 (c)(1),
(2), (4) Date: Sep. 24, 2012

(87) PCT Pub. No.: WO2011/118848

PCT Pub. Date: Sep. 29, 2011

(65) Prior Publication Data

US 2013/0011694 A1 Jan. 10, 2013

(30) Foreign Application Priority Data

Mar. 25, 2010 (JP) ..... 2010-070305

(51) Int. Cl.

| | |
|---|---|
| ***B32B 15/01*** | (2006.01) |
| ***B32B 15/04*** | (2006.01) |
| ***B32B 15/18*** | (2006.01) |
| ***C25D 5/14*** | (2006.01) |

(Continued)

(52) U.S. Cl.

CPC . *C25D 5/14* (2013.01); *C23C 22/30* (2013.01); *C23C 30/00* (2013.01); *C23C 22/24* (2013.01);

(Continued)

(58) Field of Classification Search

CPC ..... B32B 15/00; B32B 15/01; B32B 15/013; B32B 15/015; B32B 15/04; B32B 15/18; B32B 2311/22; B32B 2439/00; C23C 22/361; C23C 28/00; C23C 28/021; C23C 28/30; C23C 28/321; C23C 30/00; C23C 30/005; C23C 22/24; C23C 22/30; C25D 3/562; C25D 5/14; C25D 5/48; C25D 7/06; C25D 11/02; C25D 11/38

USPC ..... 428/632, 633, 660, 666, 667, 336, 340, 428/341, 332, 680, 679, 684, 685, 213, 214, 428/215, 216, 219, 220

See application file for complete search history.

(56) References Cited

U.S. PATENT DOCUMENTS

| | | | | |
|---|---|---|---|---|
| 4,659,394 | A | 4/1987 | Hara et al. | |
| 5,932,359 | A * | 8/1999 | Nagai et al. | 428/621 |

(Continued)

FOREIGN PATENT DOCUMENTS

| | | |
|---|---|---|
| JP | 56-169788 | 12/1981 |
| JP | 60-145380 | 7/1985 |

(Continued)

OTHER PUBLICATIONS

Machine Translation, Iwai et al., JP 08-188898, Jul. 1996.*

(Continued)

*Primary Examiner* — Michael E La Villa
(74) *Attorney, Agent, or Firm* — Kenyon & Kenyon LLP

(57) ABSTRACT

According to the present invention, a steel sheet for a container excellent in corrosion resistance, adhesion, and weldability is provided, which includes a steel sheet; a Ni plating layer which is formed on a surface of the steel sheet in an amount of plating deposition containing a Ni amount of 0.3 to 3 g/m$^2$ and contains Co in the range of 0.1 to 100 ppm; and a chromate coating layer which is formed on a surface of the Ni plating layer in an amount of coating deposition containing a converted Cr amount of 1 to 40 mg/m$^2$.

8 Claims, 3 Drawing Sheets

(51) Int. Cl.

| | |
|---|---|
| ***C23C 22/30*** | (2006.01) |
| ***C23C 30/00*** | (2006.01) |
| ***C23C 22/24*** | (2006.01) |
| ***C23C 22/36*** | (2006.01) |
| ***C23C 28/02*** | (2006.01) |
| ***C25D 11/38*** | (2006.01) |
| ***C23C 28/00*** | (2006.01) |
| ***C25D 5/48*** | (2006.01) |
| ***C25D 11/02*** | (2006.01) |
| *C25D 3/56* | (2006.01) |

(52) U.S. Cl.

CPC ..... *C23C 22/361* (2013.01); *C23C 28/021* (2013.01); *C25D 11/38* (2013.01); *C23C 28/30* (2013.01); *C25D 5/48* (2013.01); *C25D 11/02* (2013.01); *C25D 3/562* (2013.01)

USPC ..... 428/632; 428/667; 428/341; 428/679; 428/680; 428/684; 428/685; 428/213; 428/219

(56) References Cited

U.S. PATENT DOCUMENTS 6,143,422 A * 11/2000 Nagai et al. ..... 428/615
2010/0035055 A1* 2/2010 Okai et al. ..... 428/341

FOREIGN PATENT DOCUMENTS

| | | | |
|---|---|---|---|
| JP | 61-060896 | | 3/1986 |
| JP | 02-138493 | | 5/1990 |
| JP | 05-111674 | | 5/1993 |
| JP | 05-111980 | | 5/1993 |
| JP | 08-188898 | * | 7/1996 |
| JP | 2998043 | | 11/1999 |
| JP | 2000-26992 | | 1/2000 |
| JP | 3060073 | | 4/2000 |
| JP | 2000-263696 | | 9/2000 |
| JP | 2000-334886 | | 12/2000 |
| JP | 2005-149735 | | 6/2005 |
| JP | 2007-231394 | | 9/2007 |
| JP | 2010-013728 | | 1/2010 |
| WO | WO 2008/072752 | * | 6/2008 |

OTHER PUBLICATIONS

International Search Report dated Jun. 21, 2011, issued in corresponding PCT Application No. PCT/JP2011/058156.

* cited by examiner (a)

PHOTOGRAPH 1-1. CORROSION OF Ni-Co PLATING (SE IMAGE)

(b)

(ESTIMATED) CORROSION BEHAVIOR OF Ni-Co (a)

PHOTOGRAPH 1-2. CORROSION OF Ni PLATING(SE IMAGE)

(b)

(ESTIMATED) CORROSION BEHAVIOR OF Ni PLATING

STEEL SHEET FOR CONTAINER EXCELLENT IN CORROSION RESISTANCE

This application is a national stage application of International Application No. PCT/JP2011/058156, filed Mar. 24, 2011, which claims priority to Japanese Application No. 2010-070305, filed Mar. 25, 2010, the content of which is incorporated by reference in its entirety.

TECHNICAL FIELD

The present invention relates to a steel sheet for containers, in particular to a steel sheet for containers which can be used for producing two-piece cans and three-piece cans and is excellent in corrosion resistance, adhesion, and weldability.

BACKGROUND ART

Containers made of iron used mainly in the field of beverage cans may be classified as two-piece cans and three-piece cans.

Two-piece cans are can bodies in which the can bottom and the can wall have been formed as a single piece, and are represented by DrD (draw and redraw) cans, DI (drawing and ironing) cans, etc. These cans may be formed by drawing, ironing, bending and reverse bending, or a combination thereof. Steel sheets to be used for these can bodies may include tin plates (Sn-plated steel sheets) and TFS (electrolytic chromate-treated steel sheets (tin-free steel)), and these steel sheets may be used depending on the applications and processing methods used therefor.

Three-piece cans are can bodies in which the can wall and the can bottom thereof have been formed as separate pieces. Three-piece cans may be mainly in the form of welded cans in which the can wall is formed by welding. As the material for the can wall, lightly coated Sn-plated steel sheets and Ni-plated steel sheets may be employed. As the material for the can bottom, TFS, etc, may be employed.

In both the two-piece can and the three-piece can, the outside surface of the can is provided with printing, in order to appeal to consumers for commercial value of the canned goods. On the other hand, the inside surface of the can is coated with a resin so as to ensure the corrosion resistance of the can body. In the case of the two-piece can in the prior art, after the formation of the can body, the inside surface of the can is coated, for example, by spraying and the outside surface of the can is subjected to curved surface printing. Recently, it is common to use laminated two-piece cans in which the can is formed from a steel sheet which has preliminarily been laminated with a PET film (Patent Document 1 and Patent Document 2).

In addition, with respect to the welded cans for constituting the three-piece cans, the can body is hitherto produced by welding steel sheets, in which the outside surface of the can, as well as the inside surface of the can, has preliminarily been printed. However, instead of the painting or painting finish, it is common to use three-piece cans which are produced by using steel sheets (i.e., laminated steel sheets), which have preliminarily been provided with lamination with a printed PET film (Patent Document 3 and Patent Document 4).

In the production of two-piece cans, a steel sheet for a container is subjected to drawing, ironing, or bending and reverse bending. In the production of three-piece cans, a steel sheet for a container is subjected to neck forming or flanging. Further, in some cases, the steel sheet for a container is also subjected to expanding for the purpose of imparting a design to the can. Therefore, the laminated steel sheet used as a steel sheet for a container must have excellent adhesion to a film so that the laminated steel sheet can follow these processes.

Sn-plated steel sheets have excellent corrosion resistance, even with respect to an acidic content, due to the excellent sacrificial anticorrosive effects of the Sn. However, Sn-plated steel sheets do not exhibit a stable adhesion with a film because they have brittle Sn oxides present on their outermost surface layer. As a result, when Sn-plated sheets have been subjected to the above-described processings, there are problems that peeling of the film is caused, corrosion begins at sites where the adhesion strength between the film and the steel sheet is not sufficient.

Thus, a Ni-plated steel sheet which not only has excellent processability and adhesion, but also is capable of being welded is used as a laminated steel sheet for a container (Patent Documents 5). Ni-plated steel sheets have been disclosed for a long time (for example, Patent Documents 9). Some Ni-plated steel sheets have dull surfaces as in the case of Sn-plated steel sheets, while there are also ones which have been subjected to bright plating by Ni plating methods in which a brightening agent is added (Patent Document 6 and Patent Document 7).

However, since Ni does not exhibit any sacrificial anticorrosive effect such as Sn, it is known that in the case of Ni-plated steel sheets, highly corrosive contents, such as acidic drinks, cause pitting corrosion (or perforation corrosion), in which the corrosion grows in the sheet depth direction due to defects in the Ni plating layer, such as pinholes, leading to perforation. Therefore, there has been a need to improve the corrosion resistance of Ni-plated steel sheets. In order to reduce pitting corrosion, a Ni-plated steel sheet was developed in which the steel components were adjusted so that the electric potential of a steel sheet to be plated was more noble (Patent Document 8).

Citation List

Patent Document

Patent Document 1
Japanese Unexamined Patent Publication (Kokai) No. 2000-263696
Patent Document 2
Japanese Unexamined Patent Publication (Kokai) No. 2000-334886
Patent Document 3
Japanese Patent No. 3,060,073
Patent Document 4
Japanese Patent No. 2,998,043
Patent Document 5
Japanese Unexamined Patent Publication (Kokai) No. 2007-231394
Patent Document 6
Japanese Unexamined Patent Publication (Kokai) No. 2000-26992
Patent Document 7
Japanese Unexamined Patent Publication (Kokai) No. 2005-149735
Patent Document 8
Japanese Unexamined Patent Publication (Kokai) No. 60(1985)-145380
Patent Document 9
Japanese Unexamined Patent Publication (Kokai) No. 56(1981)-169788

SUMMARY OF INVENTION

Technical Problem

In the invention described in Patent Document 8, the reduction of pitting corrosion has been accomplished with effects, but there is a need for further improvement of corrosion resistance. In addition, the invention described in Patent Document 8 specifies the steel components in a limited range and is only applied to some applications. Therefore, there is a need for a Ni-plated steel sheet which can be applied to a wide variety of contents and can shapes.

The present invention has been made in view of the circumstances as described above and an object thereof is to provide a steel sheet for a container excellent in corrosion resistance.

Solution to Problem

The present inventors have devoted themselves to research and found that holding Co in a particular range to a Ni plating layer results in the suppression of pitting corrosion of base iron, thereby exerting extremely excellent effects to achieve the above-mentioned aim.

A steel sheet for the container of the present invention is based on the above findings and includes a steel sheet; a Ni plating layer which is formed on a surface of the steel sheet in an amount of plating deposition containing a Ni amount of 0.3 to 3 g/m$^2$ and contains Co in the range of 0.1 to 100 ppm; and a chromate coating layer which is formed on a surface of the Ni plating layer in an amount of coating deposition containing a converted Cr amount of 1 to 40 mg/m$^2$.

According to the present invention, a steel sheet for a container excellent in corrosion resistance, adhesion, and weldability, which includes a steel sheet; a Ni plating layer which is formed on a surface of the steel sheet in an amount of plating deposition containing a Ni amount of 0.3 to 3 g/m$^2$ and contains Co in the range of 0.1 to 100 ppm; and a chromate coating layer which is formed on a surface of the Ni plating layer in an amount of coating deposition containing a converted Cr amount of 1 to 40 mg/m$^2$, is provided.

According to the findings of the present inventors, reasons why the steel sheet for the container according to the present invention having the above-described features exerts excellent effects as presumed to be as follows.

When investigations were performed about effects on corrosion resistance of elements which were added in fine amounts to a Ni plating layer, in order to reduce the pitting corrosion, the present inventors found a phenomenon that the corrosion grows along the interface between the Ni plating layer and the base iron during growing the corrosion due to defects in the Ni plating layer such as pinholes, by including the fine amounts of Co in a Ni plating layer (see FIG. 1).

The present inventors carried on further studies and also found that the corrosion tends to grow along the interface between the Ni plating layer and the base iron, resulting in the suppression of pitting corrosion in the "depth" direction of the base iron.

The phenomenon described above was presumed, according to the findings of the present inventors, to proceed as follows. In a Ni-plated steel sheet added Co in fine amounts, by dissolving the Co which is electrochemically less noble than Ni, in the Ni plating layer, the dissolved Co ions precipitate at the base iron side between the Ni plating layer and the base iron. The corrosion would mainly occur between the precipitates Co and the base iron and grow on the interface between the Ni plating layer and the base iron.

In addition, according to the findings of the present inventors, it is considered that the ionized Co may result in a lessened passivation effect of the chromate layer or the Zr-containing coating layer on the Ni plating layer, and oxygen- or hydrogen-reducing reactions, which is corresponding to pitting corrosion of the base iron (Fe-oxidizing reaction), may occur.

By taking advantage of the above-described phenomenon, the present inventors have arrived at the invention of a steel sheet for a container excellent in corrosion resistance, adhesion, and weldability, which has the above-described features.

The present invention may include, for example, the following aspects:

[1] A steel sheet for a container excellent in corrosion resistance, adhesion, and weldability, the steel sheet including:

a steel sheet;

a Ni plating layer which is formed on a surface of the steel sheet in an amount of plating deposition containing a Ni amount of 0.3 to 3 g/m$^2$ and contains Co in the range of 0.1 to 100 ppm; and a chromate coating layer which is formed on a surface of the Ni plating layer in an amount of coating deposition containing a converted Cr amount of 1 to 40 mg/m$^2$.

[2] The steel sheet for the container according to [1], wherein the Ni amount in the Ni plating layer is 0.35 to 2.8 g/m$^2$.

[3] The steel sheet for the container according to [1] or [2], wherein the Co content in the Ni plating layer is 0.3 to 92 ppm.

[4] The steel sheet for the container according to any one of [1] to [3], wherein the amount as the converted Cr amount of deposition of the chromate coating layer is 1.2 to 38 mg/m$^2$.

[5] A steel sheet for the container excellent in corrosion resistance, adhesion, and weldability, the steel sheet including:

a steel sheet;

a Ni plating layer which is formed on a surface of the steel sheet in an amount of plating deposition containing a Ni amount of 0.3 to 3 g/m$^2$ and contains Co in the range of 0.1 to 100 ppm; and a Zr-containing coating layer which is formed on a surface of the Ni plating layer in an amount of coating deposition containing a Zr amount of 1 to 40 mg/m$^2$.

[6] The steel sheet for the container according to [5], wherein the Ni amount in the Ni plating layer is 0.42 to 2.4 g/m$^2$.

[7] The steel sheet for the container according to [5] or [6], wherein the Co content in the Ni plating layer is 0.1 to 89 ppm.

[8] The steel sheet for the container according to any one of [5] to [7], wherein the amount as the converted Zr amount of deposition of the Zr-containing coating layer is 1 to 37 mg/m$^2$.

Advantageous Effects of Invention

According to the present invention, a steel sheet for the container is excellent in corrosion resistance, and additionally in adhesion with a laminated resin film and weldability is provided.

DESCRIPTION OF EMBODIMENTS

Figure 1:
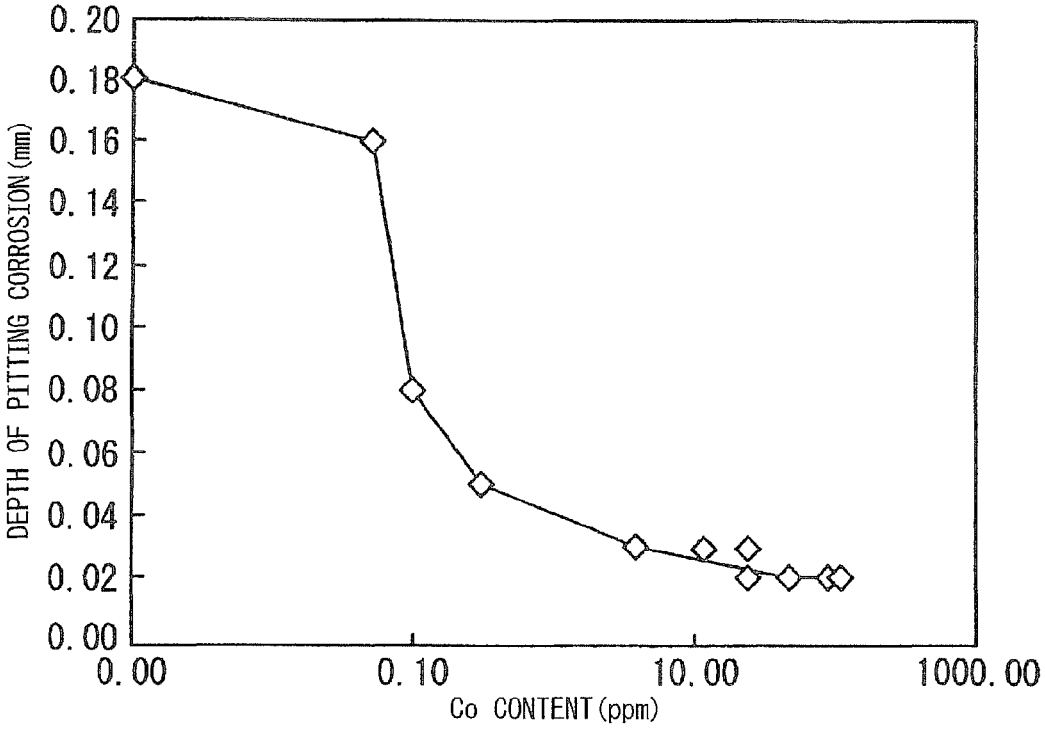
FIG. 1 is a graph showing a relationship between the Co concentration in a Ni plating and the depth of pitting corrosion.
Figure 2:
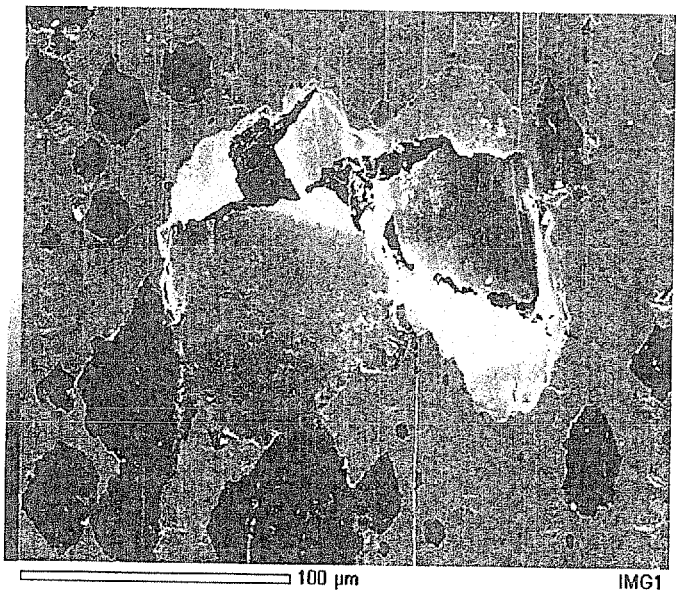
FIG. 2(*a*) is an SE (scanning electron microscope) image showing an example of corrosion of a Ni—Co plating, and FIG. 2(*b*) is a schematic cross-section view showing an (estimated) corrosion behavior of the Ni—Co plating.
Figure 2:
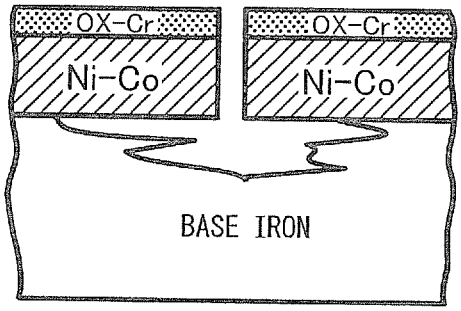
Figure 3:
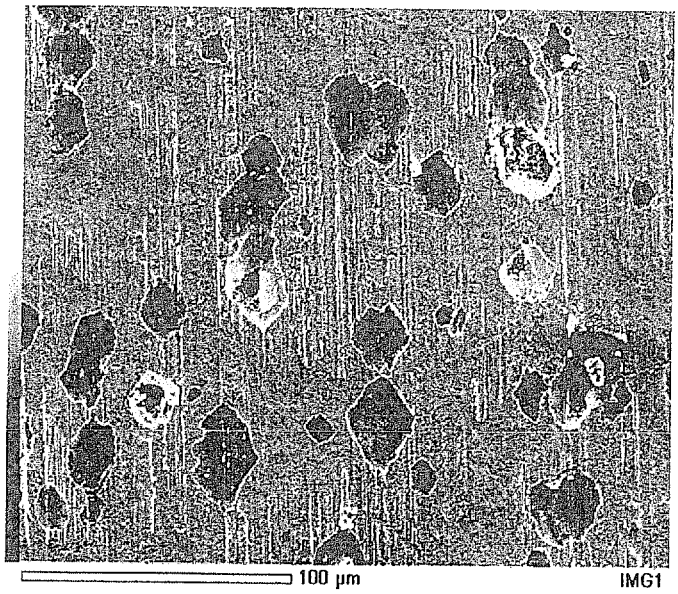
FIG. 3(*a*) is an SE image showing an example of corrosion of a Ni plating, and FIG. 3(*b*) is a schematic cross-section view showing an (estimated) corrosion behavior of the Ni plating.
Figure 3:
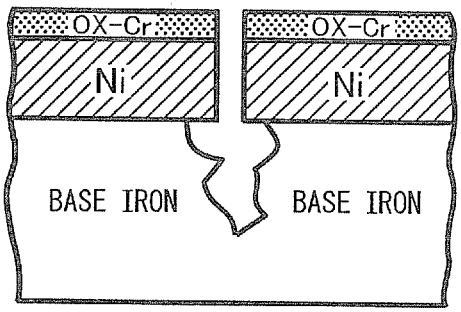

The following will describe in details a steel sheet for the container excellent in corrosion resistance, adhesion, and weldability, which are embodiments of the present invention.

A steel sheet for the container excellent in corrosion resistance, adhesion, and weldability according to an embodiment of the present invention features comprising a steel sheet; a Ni plating layer which is formed on a surface of the steel sheet in an amount of plating deposition containing a Ni amount of 0.3 to 3 g/m$^2$ and contains Co in the range of 0.1 to 100 ppm; and a chromate coating layer or a Zr-containing coating layer which is formed on a surface of the Ni plating layer.

The chromate coating layer is formed on a surface of the Ni plating layer in an amount of coating deposition containing a converted Cr amount of 1 to 40 mg/m$^2$. The Zr-containing coating layer is formed on a surface of the Ni plating layer in an amount of coating deposition containing a Zr amount of 1 to 40 mg/m$^2$.

The steel sheet is a material plate for plating from the steel sheet for the container and can be, by way of example, steel sheets produced through hot rolling, acid cleaning, cold rolling, annealing, temper rolling, and other common processes from usual processes of producing steel slabs.

A steel sheet as a material plate for plating has a Ni plating layer formed which contains Co in fine amounts, in order to ensure corrosion resistance, adhesion, and weldability. Since Ni is a metal which has adhesion to the steel sheet together with forge weldability (property of joining a steel sheet(s) at lower melting temperature of the steel sheet(s)), the Ni plating layer begins to exert practical properties of adhesion and welding by increasing the Ni amount to 0.3 g/m$^2$ or more as the amount of plating deposition in applying Ni plating to the steel sheet. Further increasing the amount of Ni plating deposition improves adhesion and welding properties, whereas amounts of deposition of more than 3 g/m$^2$ leads to saturation of improvement effect on adhesion and welding properties, and this is industrially disadvantageous. Therefore, the amount of deposition of the Ni plating layer needs to be from 0.3 to 3 g/m$^2$.

The Co content in the Ni plating layer which is too low is not preferable because the direction of growth of corrosion is the sheet-depth direction of the steel sheet and pitting corrosion becomes dominant. At the Co content of 0.1 ppm or more in the Ni plating layer, the corrosion begins to grow along the interface the Ni plating layer and the base iron. On the other hand, at the Co content in the Ni plating layer which become excessive, the forge weldability of Ni is inhibited, resulting in deteriorated weldability. Therefore, the Co content in the Ni plating layer needs to be 100 ppm or less.

In addition to Co, the Ni plating layer contains inevitable impurities and the remaining Ni.

As methods by which the above-described Ni-plating layer containing Co is formed on the steel sheet, are industrially useful, without being particularly limited to, methods by which a solution in which cobalt sulfate or cobalt chloride is dissolved in a known acidic nickel-plating solution composed of nickel sulfate or nickel chloride is used as a plating bath and cathode electrolysis is carried out.

Onto the Ni plating layer, chromate treatment is applied in order to enhance corrosion resistance and adhesion by a resin film, particularly, secondary adhesion after processing. Chromate treatment results in the formation of a chromate coating composed of hydrated Cr oxide or of hydrated Cr oxide and metallic Cr.

The metallic Cr or hydrated Cr oxide making up the chromate coating are excellent in chemical stability and will improve the corrosion resistance of the steel sheet for the container in proportion to the amount of the chromate coating. In addition, the hydrated Cr oxide exhibits excellent adhesion even under a steam atmosphere by forming strong chemical bonding with functional groups of a resin film and will improve the adhesion with the resin film with increasing amounts of the chromate coating layer. The chromate coating layer containing the converted metallic Cr amount of 1 mg/m$^2$ or more is needed to exert sufficient degrees of corrosion resistance and adhesion.

Although the increase in the amount of deposition of the chromate coating layer also increases improvement effect on corrosion resistance and adhesion, increasing the amount of deposition of the chromate coating layer results in highly increased electric resistance of the steel sheet for the container, thereby causing deterioration of its weldability, due to the fact that the hydrated Cr oxide in the chromate coating layer is an electric insulator. Specifically, weldability is extremely deteriorated when the amount of deposition of the chromate coating layer exceeds 40 mg/m$^2$ equivalent to the converted metallic Cr. Therefore, the amount of the deposition of the chromate coating layer containing the converted metallic Cr needs to be 40 mg/m$^2$ or less.

A method for chromate treatment may be carried out by any method, such as dipping, spraying, electrolysis, and other treatments using aqueous solutions of sodium, potassium, ammonium salts of various Cr acids. It is industrially excellent to apply cathode electrolysis treatment in an aqueous solution in which sulfate ions, fluoride ions (including complex ions) or a mixture thereof are added as plating assistant to the Cr acid.

A Zr-containing coating layer may be formed on the Ni plating layer, instead of the above-described chromate coating layer. The Zr-containing coating layer is a coating composed of Zr compounds such as Zr oxide, Zr phosphate, Zr hydroxide, Zr fluoride, or the like, or a complex coating composed thereof. When the Zr-containing coating layer is formed in an amount of coating deposition containing the converted metallic Zr amount of 1 mg/m$^2$ or more, a dramatic improvement in adhesion with a resin film and in corrosion resistance is observed as in the case of the above-described chromate coating layer. On the other hand, when the amount of deposition of the Zr-containing coating layer containing the converted metallic Zr amount exceeds 40 mg/m$^2$, weldability and appearance properties are deteriorated. Particularly, when the amount of deposition of the Zr-containing coating layer containing the converted metallic Zr exceeds 40 mg/m$^2$, weldability is extremely deteriorated because the Zr-containing coating layer is an electric insulator and has a very high electric resistance, thereby causing deterioration of the weldability. Therefore, the amount of deposition of the Zr-containing coating layer containing the converted metallic Zr amount needs to be from 1 to 40 mg/m$^2$.

In embodiments of the present invention using the chromate coating layer, the following ranges are preferable:

Ni amount in the Ni plating layer (g/m$^2$): 0.35 to 2.8 (more preferably, 0.6 to 2.4; further preferably, 0.8 to 1.8), Co content in the Ni plating layer (ppm): 0.3 to 92 (more preferably, 0.3 to 25; further preferably, 0.3 to 24), an amount as the converted Cr amount of deposition of the chromate coating layer (mg/m$^2$): 1.2 to 38 (more preferably, 4 to 22; further preferably, 5 to 22).

As a method for forming the Zr-containing coating layer, for example, a method by which a steel sheet after formation of the Ni plating layer is subjected to dipping treatment in an acidic solution having as the main components Zr fluoride, Zr phosphate, and hydrofluoric acid, or to cathode electrolysis treatment, may be used.

In embodiments of the present invention using the Zr-containing coating layer, the following ranges are preferable:

Ni amount in the Ni plating layer ($g/m^2$): 0.42 to 2.4 (more preferably, 0.8 to 2.4; further preferably, 1.1 to 2.4), Co content in the Ni plating layer (ppm): 0.1 to 89 (more preferably, 0.2 to 89; further preferably, 0.2 to 47), an amount as the converted Zr amount of deposition of the Zr-containing coating layer ($mg/m^2$): 1 to 37 (more preferably, 12 to 37; further preferably, 12 to 28).

According to embodiments of the present invention, it is possible to improve resistance to pitting corrosion of the steel sheet for the container and enhance weldability, and adhesion to a resin film or to the processed resin film.

EXAMPLES

The present invention will be described in detail.

First, Examples and Comparative Examples of the present invention are described, and their results are shown in Table 1. Sample pieces were prepared by the methods described in (1) and performed an evaluation of items (A) to (D) described in (2).

(1) Method for Preparing Sample Pieces

Steel Sheet (Material Plate for Plating):

A Temper-Grade 3 (T-3) tin cold-rolled steel sheet having a sheet thickness of 0.2 mm was used as a material plate for plating.

Conditions for Ni Plating:

Cobalt sulfate was added in an amount of 0.1 to 1% to an aqueous solution which contained nickel sulfate in a concentration of 20%, nickel chloride in a concentration of 15%, and boric acid in a concentration of 1% and was adjusted to pH=2, and cathode electrolysis was performed at 5 $A/dm^2$ to form a Ni plating layer on the steel sheet. The amount of Ni deposition was controlled by the time of electrolysis.

Conditions for Chromate Treatment:

Cathode electrolysis was performed at 10 $A/dm^2$ in an aqueous solution which contained chromium(VI) oxide in a concentration of 10%, sulfuric acid in a concentration of 0.2%, and ammonium fluoride in a concentration of 0.1%, followed by washing with water for 10 seconds, to form a chromate coating layer on the Ni plating layer. The amount of Cr deposition in the chromate coating layer was controlled by the period of time of electrolysis.

Conditions for Zr-Containing Coating Layer Treatment:

Cathode electrolysis was performed at 10 $A/dm^2$ in an aqueous solution which contained zirconium fluoride in a concentration of 5%, phosphoric acid in a concentration of 4%, and hydrofluoric acid in a concentration of 5%, to form a Zr-containing coating layer on the Ni plating layer. The amount of Zr deposition in the Zr-containing coating layer was controlled by the time of electrolysis.

<Methods for Measuring Plating Amount>

Amounts of Ni, Zr, and Cr were determined with fluorescent X-ray. For Co, a plating layer was dissolved in 10% hydrochloric acid, and the Co concentration was determined by atomic absorption analysis and calculated.

(2) Methods for Evaluation of Sample Pieces (A) Weldability

After laminated a 15 μm thick PET film onto a test piece, welding was performed under conditions of a lap of 0.5 mm, a welding pressure of 45 kgf, a welding wire speed of 80 m/min, and varying currents. The range of conditions for suitable welding was considered by the range of suitable currents determined by the minimum current value which sufficient welding strength was obtained, and the maximum current value which welding defects such as expulsion and surface flash began to appear, and a welding state. Evaluation was done on a four-grade scale (AA: very wide, A: wide, B: practically no problems, C: narrow).

(B) Adhesion

After laminated a 15 μm thick PET film onto a sample piece, a cup was fabricated in a DrD press. The cup was formed into a DI can in a DI machine. Peeling levels of the film on the can wall of the formed DI can were observed. Evaluation was holistically done on a four-grade scale (AA: not peeled at all, A: slight floating of the film, B: large peeling, C: the film was peeled during DI forming and finally the drum was broken).

(C) Secondary Adhesion

A 15 μm thick PET film was laminated onto a sample piece, from which a cup was fabricated in a DrD press. The cup was formed into a DI can in a DI machine. The DI can was subjected to heat treatment for 10 minutes at a temperature (around 240° C.) exceeding the melting point of the PET film, followed by further treatment under a steam atmosphere at 125° C. for 30 minutes (retort treatment). Peeling levels of the film on the can wall of the retort-treated DI can were observed. Evaluation was holistically done on a four-grade scale (AA: not peeled at all, A: slight floating of the film, B: large peeling, C: the film was peeled during DI forming and finally the drum was broken).

(D) Corrosion Resistance

After a welded can laminated with a PET film was fabricated a repair paint is applied on the weld. The weld can was filled with a testing solution of a mixture of 1.5% citric acid and 1.5% salt, fitted with a top, and set in a temperature-controlled room at 55° C. for one month. Evaluation was done by assessing corrosion levels at film scuffing sites inside the welded can on a four-grade scale (AA: no pitting corrosion, A: slight pitting corrosion with practically no problems, B: grown pitting corrosion, C: perforation due to pitting corrosion). In addition, 10 corrosion sites were observed under an optical microscope to determine the average value of corrosion depths.

Table 1 shows the results of evaluation of weldability, adhesion, secondary adhesion, and corrosion resistance for Examples 1 to 11 and Comparative Examples 1 to 7 in which the amount of deposition of the Ni plating layer, the Co content, and the chromate coating layer or Zr-containing coating layer were changed. In Table 1, numerical values which were not ranged in those of the present invention were underlined.

TABLE 1

| | | Ni plating layer | | Chromate | Zr-containing | | | | Corrosion resistance | |
|---|---|---|---|---|---|---|---|---|---|---|
| | No. | Ni amount ($g/m^2$) | Co content (ppm) | coating layer ($mg/m^2$) | coating layer ($mg/m^2$) | Weldability | Adhesion | Secondary adhesion | Corrosion levels | Corrosion depth (um) |
| Examples | 1 | 2.8 | 92 | 1.2 | — | AA | AA | A-AA | AA | 8 |
| | 2 | 1.2 | 25 | 15 | — | AA | AA | AA | AA | 7 |
| | 3 | 0.8 | 0.3 | 4 | | AA | AA | AA | AA | 10 |

TABLE 1-continued

| | No. | Ni plating layer Ni amount ($g/m^2$) | Ni plating layer Co content (ppm) | Chromate coating layer ($mg/m^2$) | Zr-containing coating layer ($mg/m^2$) | Weldability | Adhesion | Secondary adhesion | Corrosion resistance Corrosion levels | Corrosion resistance Corrosion depth (um) |
|---|---|---|---|---|---|---|---|---|---|---|
| | 4 | 0.35 | 0.1 | 5 | — | AA | AA | AA | A-AA | 18 |
| | 5 | 0.6 | 3.8 | 38 | — | AA | AA | AA | AA | 11 |
| | 6 | 2.4 | 24 | 8 | | AA | AA | AA | AA | 7 |
| | 7 | 1.8 | 12 | 22 | — | AA | AA | AA | AA | 5 |
| | 8 | 0.42 | 0.1 | — | 1 | AA | AA | A-AA | A-AA | 24 |
| | 9 | 0.8 | 0.2 | — | 12 | AA | AA | AA | AA | 12 |
| | 10 | 1.1 | 47 | — | 28 | AA | AA | AA | AA | 13 |
| | 11 | 2.4 | 89 | — | 37 | AA | AA | AA | AA | 4 |
| Comparative Examples | 1 | 0.25 | 24 | 10 | — | C-B | A | B-A | B-C | 160 |
| | 2 | 1.3 | 0 | 21 | — | AA | AA | AA | C | 140 |
| | 3 | 0.8 | 110 | 7 | — | C | AA | AA | AA | 15 |
| | 4 | 2.5 | 44 | 0.7 | — | AA | AA | C | A | 22 |
| | 5 | 0.6 | 2 | 45 | — | C | AA | AA | AA | 14 |
| | 6 | 1.5 | 4 | — | 0.1 | AA | AA | C | A | 18 |
| | 7 | 0.8 | 32 | — | 48 | C | AA | AA | AA | 5 |

As shown in Table 1, all of the steel sheets of Examples 1 to 11 have excellent in weldability, adhesion, secondary adhesion, and corrosion resistance.

Comparative Example 1 had a decreased amount of deposition of the Ni plating layer and resulted in decreased weldability and corrosion resistance.

Comparative Examples 2 and 3 had a Co content in the Ni plating layer, which was not ranged in that of the present invention and resulted in decreased corrosion resistance (Comparative Example 2) and decreased weldability (Comparative Example 3), respectively.

Comparative Examples 4 and 5 had an amount of deposition of the chromate coating layer, which was not ranged in that of the present invention and resulted in decreased secondary adhesion (Comparative Example 4) and decreased weldability (Comparative Example 5), respectively.

Comparative Examples 6 and 7 had an amount of deposition of the Zr-containing coating layer, which was not ranged in that of the present invention and resulted in decreased secondary adhesion (Comparative Example 6) and decreased weldability (Comparative Example 7), respectively.

As a material plate for plating were used a plurality of Temper-Grade 3 (T-3) tin cold-rolled steel sheets having a sheet thickness of 0.2 mm and subjected to plating under Ni plating conditions similar to those described above, thereby to form a Ni plating layer on each of the steel sheets. For all of the Ni plating layers, the amount of Ni deposition was set at a fixed amount of 0.7 $g/m^2$.

Subsequently, a chromate coating layer was formed on each of the Ni plating layers under chromate treatment conditions similar to those described above. For all of the chromate coating layers, the amount of Cr deposition in each of the chromate coating layers was set at a fixed amount of 8 $g/m^2$.

For a variety of the obtained steel sheets, the corrosion resistance test was performed as described above and the depth of pitting corrosion was determined. The results are shown in FIG. 1.

As shown in FIG. 1, it was found that a Co content in the Ni plating layer was in the range of 0.1 to 100 ppm, the depth of pitting corrosion was in the range of 0.02 to 0.08 mm and the corrosion resistance to pitting corrosion was greatly improved. At the Co content in the range of 0.1 to 100 ppm, the corrosion was observed to grow along the between the Ni plating layer and the base iron. At the Co content in the range of less than 0.1 ppm, on the other hand, the corrosion was observed to grow along in the sheet-depth direction.

The invention claimed is:

1. A steel sheet for a container excellent in corrosion resistance, adhesion, and weldability, the steel sheet comprising:

a steel sheet;

a Ni plating layer of which surface is formed directly on a surface of the steel sheet, consisting of 0.3 to 3 $g/m^2$ of Ni, 0.1 to 100 ppm by mass of Co with respect to the Ni plating layer, and inevitable impurities; and a chromate coating layer which is formed directly on a surface of the Ni plating layer, containing a converted metallic Cr amount of 1 to 40 $mg/m^2$.

2. The steel sheet for the container according to claim 1, wherein the Ni plating layer contains 0.35 to 2.8 $g/m^2$ of Ni.

3. The steel sheet for the container according to claim 1 or 2, wherein the Ni plating layer contains 0.3 to 92 ppm by mass of Co.

4. The steel sheet for the container according to claim 1 or 2, wherein the chromate coating layer contains a converted metallic Cr amount of 1.2 to 38 $mg/m^2$.

5. A steel sheet for a container excellent in corrosion resistance, adhesion, and weldability, the steel sheet comprising:

a steel sheet;

a Ni plating layer of which surface is formed directly on a surface of the steel sheet, consisting of 0.3 to 3 $g/m^2$ of Ni, 0.1 to 100 ppm by mass of Co with respect to the Ni plating layer, and inevitable impurities; and a Zr-containing coating layer which is formed directly on a surface of the Ni plating layer, containing a converted metallic Zr amount of 1 to 40 $mg/m^2$.

6. The steel sheet for the container according to claim 5, wherein the Ni plating layer contains 0.42 to 2.4 $g/m^2$ of Ni.

7. The steel sheet for the container according to claim 5 or 6, wherein the Ni plating layer contains 0.1 to 89 ppm by mass of Co.

8. The steel sheet for the container according to claim 5 or 6, wherein the Zr-containing coating layer contains a converted metallic Zr amount of 1 to 37 $mg/m^2$.

* * * * *